US010766662B2

(12) United States Patent
Key

(10) Patent No.: US 10,766,662 B2
(45) Date of Patent: Sep. 8, 2020

(54) INTEGRATED CARTON RECLOSE FEATURE

(71) Applicant: Kellogg Company, Battle Creek, MI (US)

(72) Inventor: Travis Bernard Key, Portage, MI (US)

(73) Assignee: KELLOGG COMPANY, Battle Creek, MI (US)

( * ) Notice: Subject to any disclaimer, the term of this patent is extended or adjusted under 35 U.S.C. 154(b) by 59 days.

(21) Appl. No.: 15/999,402

(22) Filed: Aug. 20, 2018

(65) Prior Publication Data

US 2019/0055048 A1 Feb. 21, 2019

Related U.S. Application Data

(60) Provisional application No. 62/548,007, filed on Aug. 21, 2017.

(51) Int. Cl.

*B65D 5/42* (2006.01)
*B65D 33/16* (2006.01)
*B65D 77/06* (2006.01)

(52) U.S. Cl.

CPC ..... *B65D 5/42* (2013.01); *B65D 33/1625* (2013.01); *B65D 77/062* (2013.01); *B65D 2577/043* (2013.01)

(58) Field of Classification Search

CPC .... B65D 5/42; B65D 33/1625; B65D 77/062; B65D 5/483; B65D 5/643

USPC ..... 229/117.34, 117.35, 125.39, 232, 241, 229/155, 117.32, 222; 220/315, 652; 24/563, 30.5 S, 546, 30.5 R, 562; 383/78, 383/89; 53/417, 138.3

See application file for complete search history.

(56) References Cited

U.S. PATENT DOCUMENTS 4,262,816 A * 4/1981 Margulies ..... A47K 10/3818 206/409
6,298,526 B1 * 10/2001 Baumdicker ..... A44B 99/00 24/306
7,284,688 B1 * 10/2007 Barsness et al. ..... B65D 5/643 229/125.39
2007/0119914 A1 * 5/2007 Mestre ..... B65D 5/549 229/117.34
2014/0048439 A1 2/2014 Vulgamott (Continued)

FOREIGN PATENT DOCUMENTS

JP 20150193387 11/2015
WO 2007/084525 7/2007

OTHER PUBLICATIONS

International Search Report for PCT/US2018/000341 dated Nov. 7, 2018.

*Primary Examiner* — Christopher R Demeree
(74) *Attorney, Agent, or Firm* — Honigman LLP; Kathryn D. Doyle, Esq.; Jonathan P. O'Brien

(57) ABSTRACT

A storage assembly comprises a sleeve and a container. The sleeve defines an interior void operable to receive a foodstuff. The container defines an interior cavity operable to receive the sleeve. The container includes a first sidewall and a second sidewall. A first flap is attached to the first sidewall and a second flap is attached to the second sidewall. The second flap includes at least one clip removably attached to the second sidewall. The clip comprises an aperture for receiving a portion of the sleeve therein.

8 Claims, 10 Drawing Sheets

(56) References Cited

U.S. PATENT DOCUMENTS

| | | | | |
|---|---|---|---|---|
| 2014/0250635 | A1* | 9/2014 | Vantrease | B65D 33/16<br>24/30.5 S |
| 2015/0117799 | A1 | 4/2015 | Marchionda | |
| 2018/0105327 | A1* | 4/2018 | Villacorta Atienza | B65D 33/1675 |

* cited by examiner

INTEGRATED CARTON RECLOSE FEATURE

CROSS REFERENCE TO RELATED APPLICATIONS

This application claims priority under 35 U.S.C. § 119(e) to U.S. Provisional Application 62/548,007 filed on Aug. 21, 2017. The disclosure of this prior application is considered part of the disclosure of this application and is hereby incorporated by reference in its entirety.

TECHNICAL FIELD

This disclosure relates to a food packaging system and an integrated carton reclose feature.

BACKGROUND

Food packaging and storage systems are known. For example, containers for storing several individual packages are known. While existing packaging and storage configurations perform adequately for their intended purpose, improvements to packaging and storage configurations are continuously being sought in order to advance the arts.

SUMMARY

This section provides a general summary of the disclosure, and is not a comprehensive disclosure of its full scope or all of its features.

One aspect of the present disclosure provides a storage assembly comprising a sleeve and a container. The sleeve defines an interior void operable to receive a foodstuff. The container defines an interior cavity operable to receive the sleeve. The container comprises a clip removably attached to the container and having an aperture for receiving a portion of the sleeve therein.

Implementations of the disclosure may comprise one or more of the following optional features. For example, the container may comprise an opening at a first end, and the clip may be removably attached to the container adjacent the opening. The clip may be removably attached to the container along a perforated seam.

In some implementations, the interior cavity of the container may be defined by a first sidewall and the clip may be removably attached to a terminal end of the sidewall. A pair of the clips may be removably attached to the terminal end of the sidewall. The pair of clips can be removably attached to each other along a common seam. The pair of clips may define a flap of the container.

In some implementations, the clip comprises a passage extending between the aperture and an outer perimeter of the clip.

In some aspects, the sleeve is a cylindrical sleeve and the container is a box.

In some examples, the container is operable to receive a plurality of the sleeves, and the container comprises a plurality of the clips equal to the plurality of the sleeves.

In another aspect of the disclosure, a storage assembly comprises a container defining an interior cavity. The container comprises a first sidewall and a second sidewall. A first side flap is fixedly attached to the first sidewall and a second side flap is removably attached to the second sidewall of the container. The second side flap comprises an aperture formed therethrough.

In some implementations, the second side flap comprises a first clip and a second clip attached to each other along a perforated seam.

In some examples, the second side flap is attached to the second edge of the container along a perforated seam.

In some examples, the second side flap comprises a passage extending from the aperture to an outer perimeter of the second side flap. The passage may comprise a tapered inlet disposed adjacent the outer perimeter.

In some implementations, the aperture comprises a first pair of converging sidewalls and a second pair of straight sidewalls connecting the converging sidewalls. The aperture may be hourglass shaped.

In some implementations, the first side flap and the second side flap are operable between an open position to expose the interior cavity of the container, and a closed position to enclose the interior cavity of the container. In the closed position, second side flap may be concealed by the first side flap.

In some implementations, the sidewall, the first side flap, and the second side flap are integrally formed.

The details of one or more implementations of the disclosure are set forth in the accompanying drawings and the description below. Other aspects, features, and advantages will be apparent from the description and drawings, and from the claims.

DESCRIPTION OF DRAWINGS

The drawings described herein are for illustrative purposes only of selected configurations and not all possible implementations, and are not intended to limit the scope of the present disclosure.

Like reference symbols in the various drawings indicate like elements.

DETAILED DESCRIPTION

Figure 1:
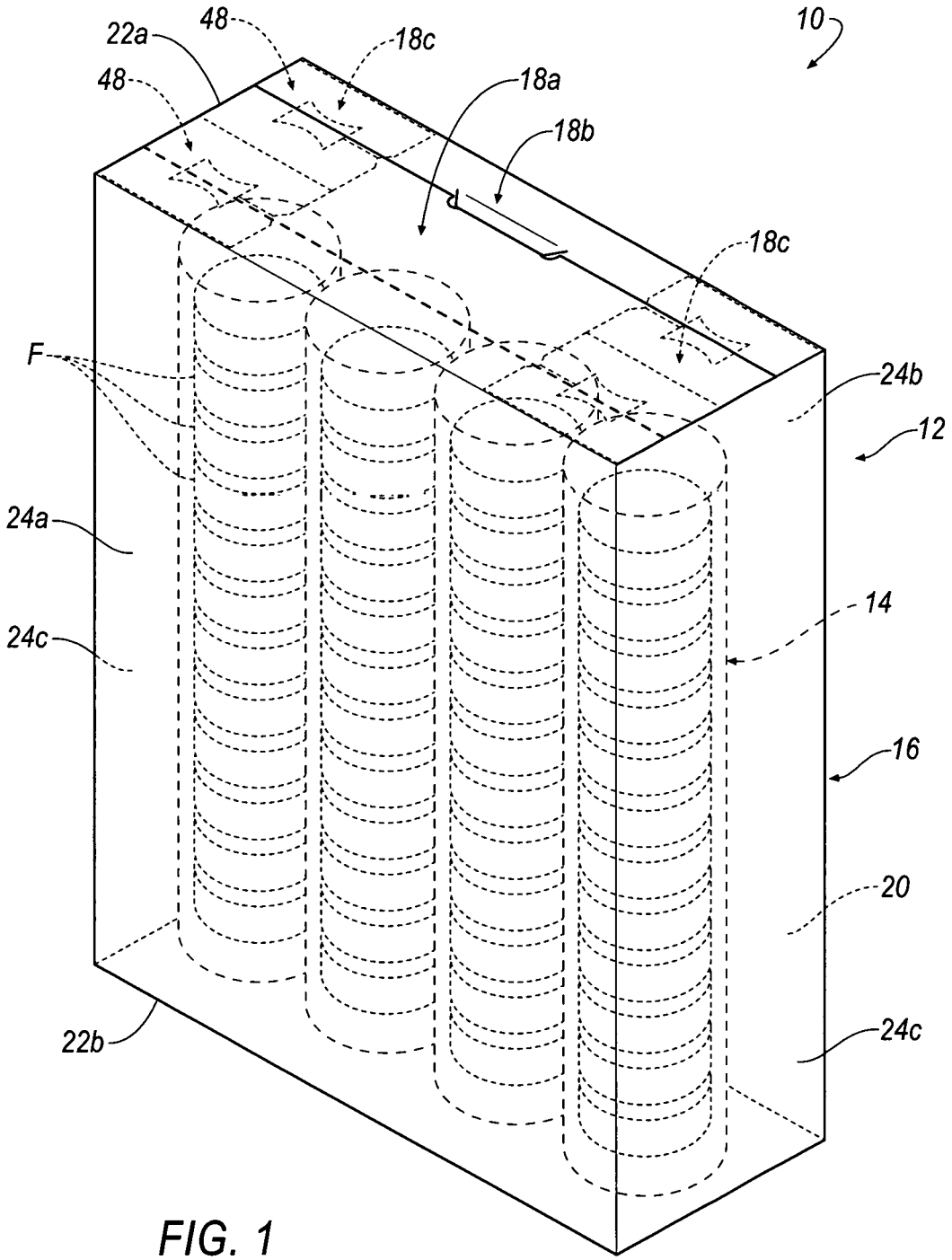
FIG. 1 is a perspective view illustrating a storage assembly comprising a container and a plurality of sleeves.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to comprise the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" comprises any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

Referring to FIGS. 1-7, one example of a storage assembly 10 according to the instant disclosure comprises a container 12 and a plurality of sleeves 14 disposed within the container 12. The sleeves 14 are configured to store a plurality of foodstuffs F, as discussed further, below.

In some examples, the container 12 comprises a main body 16 and a plurality of flaps 18*a*, 18*b*, 18*c* extending from a first end of the main body 16. Generally, the flaps 18*a*, 18*b*, 18*c* are operable between a closed position, as shown in FIG. 1A, and an open position, as shown in FIG. 1B, to selectively enclose and expose an interior cavity 20 of the container 12. In the illustrated embodiment, the flaps 18*a*, 18*b*, 18*c* are shown and described with respect to a first end 22*a* of the container 12. Additionally, or alternatively, a second end 22*b* of the container 12 may comprise flaps (see, e.g., FIG. 7) for providing a second opening to the interior cavity 20. However, the second end 22*b* of the container 12 may be sealed by other means, such as a single flap, a detachable cover or lid, or the like.

Referring again to FIGS. 1-7, the main body 16 of the container 12 comprises one or more sidewalls 24*a*, 24*b*, 24*c* defining the interior cavity 20. For example, the container 12 may comprise four sidewalls 24*a*, 24*b*, 24*c* defining a box-shaped interior cavity 20. The sidewalls 24*a*, 24*b*, 24*c* comprise a front sidewall 24*a*, and opposing back sidewall 24*b*, and a pair of end sidewalls 24*c* extending between the front sidewall 24*a* and the back sidewall 24*b*. Terminal ends 26*a*, 26*b*, 26*c* of each of the front sidewall 24*a*, the back sidewall 24*b*, and the end sidewalls 24*c* collectively define an opening 28 into the interior cavity 20 of the container 12.

As shown, the end sidewalls 24*c* are shorter in length than the front and back sidewalls 24*a*, 24*b*, and define a lateral dimension of the container 12, while the front and back sidewalls, 24*a*, 24*b* define a longitudinal dimension of the container 12. However, in alternate implementations, the end sidewalls 24*c* may be equal to or greater in length than the front and back sidewalls 24*a*, 24*b*. In other examples, the container 12 may comprise more than or less than four sidewalls. For example, the container 12 may comprise a single cylindrical sidewall, or may comprise three sidewalls to define a triangular interior cavity 20. Furthermore, although the sidewalls 24*a*, 24*b*, 24*c* of the illustrated example are substantially planar, the sidewalls 24*a*, 24*b*, 24*c* may have curved or irregular profiles. Additionally or alternatively, the sidewalls 24*a*, 24*b*, 24*c* may comprise cutout portions or windows for providing visibility into the interior cavity 20 of the container 12.

Figure 2:
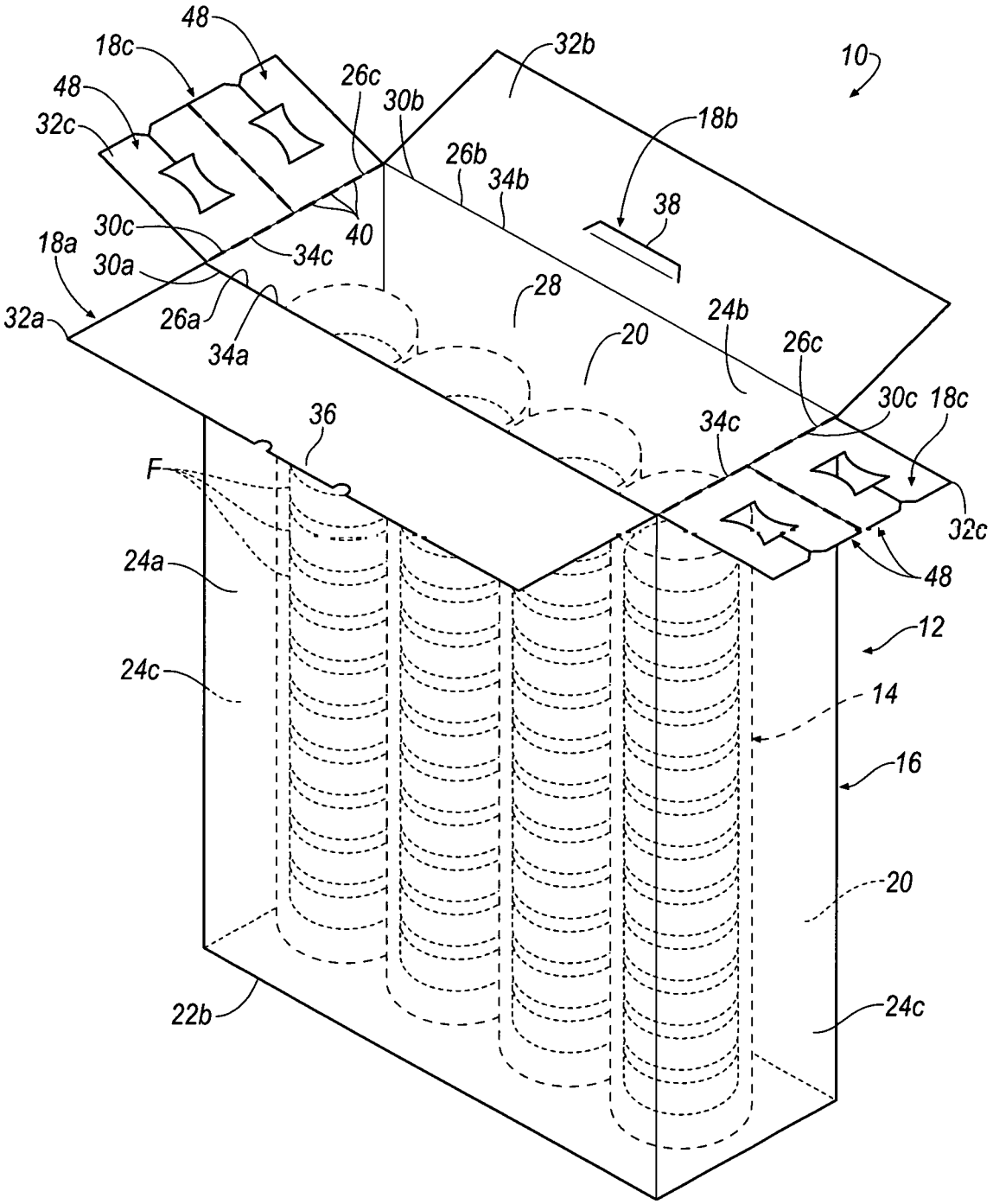
FIG. 2 is a perspective view of the storage assembly of FIG. 1, where the container is in an open position.

With reference to FIG. 2, the flaps 18*a*, 18*b*, 18*c* of the container 12 extend from the terminal ends 26*a*, 26*b*, 26*c* of each of the respective sidewalls 24*a*, 24*b*, 24*c*, and are configured to selectively open and close the opening 28 of the container 12. Particularly, a front-side flap 18*a*, a back-side flap 18*b*, and a pair of end flaps 18*c* extend from the terminal ends 26*a*, 26*b*, 26*c* of each of the front sidewall 24*a*, the back sidewall 24*b*, and the end sidewalls 24*c*, respectively. Each flap 18*a*, 18*b*, 18*c* comprises a proximal end 30*a*, 30*b*, 30*c* joined to the main body 16 and a distal end 32*a*, 32*b*, 32*c* extending away from the main body 16. Particularly, the proximal end 30*a*, 30*b*, 30*c* of each of the flaps 18*a*, 18*b* 18*c* is joined to the terminal end 26*a*, 26*b*, 26*c* of the each of the sidewalls 24*a*, 24*b*, 24*c* along a respective flap seam 34*a*, 34*b*, 34*c*. The flap seams 34*a*, 34*b*, 34*c* may function as living hinges to allow each of the flaps 18*a*, 18*b*, 18*c* to be moved between the open and closed positions. Particularly, the flaps 18*a*, 18*b*, 18*c* may rotate about axes defined by the respective flap seams 34*a*, 34*b*, 34*c*.

The front-side flap 18*a* and the back-side flap 18*b* may comprise a closure, which is operable to maintain the flaps 18*a*, 18*b*, 18*c* in the closed position. For example, the front-side flap 18*a* may comprise a tongue 36 configured to engage a corresponding slit 38 formed in the back-side flap 18*b* when the front-side flap 18*a* and the back-side flap 18*b* are in the closed position. In other examples, the closure may be an adhesive, a mechanical fastener, such as a zipper or button, or the like.

Referring to FIG. 2, at least one of the end flaps 18*c* is removably attached to the main body 16. For example, the flap seams 34*c* joining the end flaps 18*c* to the main body 16 may comprise perforations 40 formed therein. The perforations 40 provide a predefined tear path for removing the end flaps 18*c* from the main body 16 with minimized effort.

At least one of the end flaps 18*c* defines a clip 48 configured to receive the sleeve 14 therein. In the illustrated example, each of the end flaps 18*c* comprises a pair of the clips 48. Accordingly, a single clip 48 may be provided for each of the sleeves 14 comprised in the storage assembly 10.

In other examples, each of the end flaps 18*c* may comprise more or less than two of the clips 48, as desired. Additionally or alternatively, the front-side flap 18*a* and/or the back-side flap 18*b* may comprise one or more of the clips 48, formed similarly to the clips 48 of the end flaps 18*c* described herein.

Figure 6:
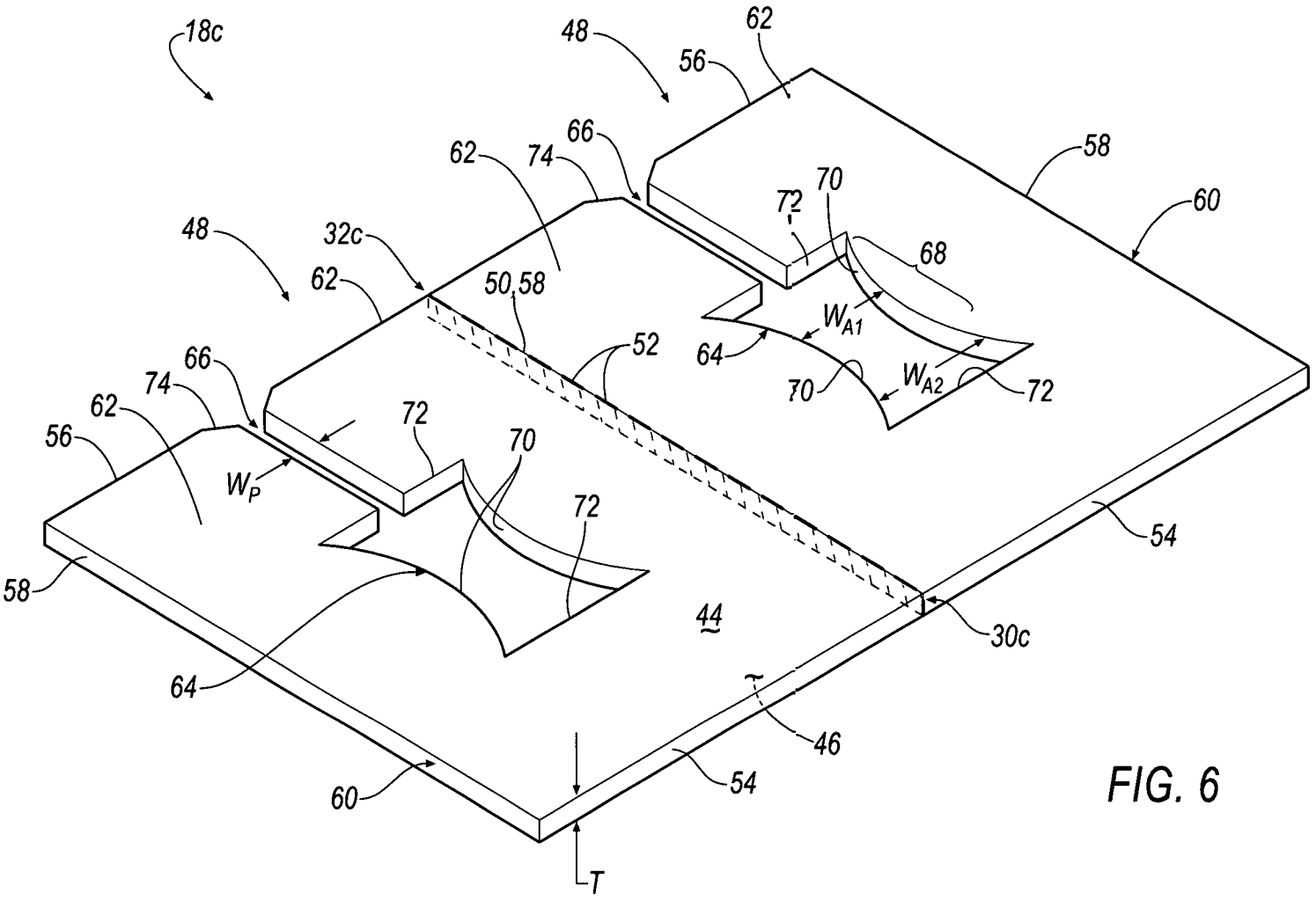
FIG. 6 is an enlarged perspective view of an end flap of the container.
Figure 8:
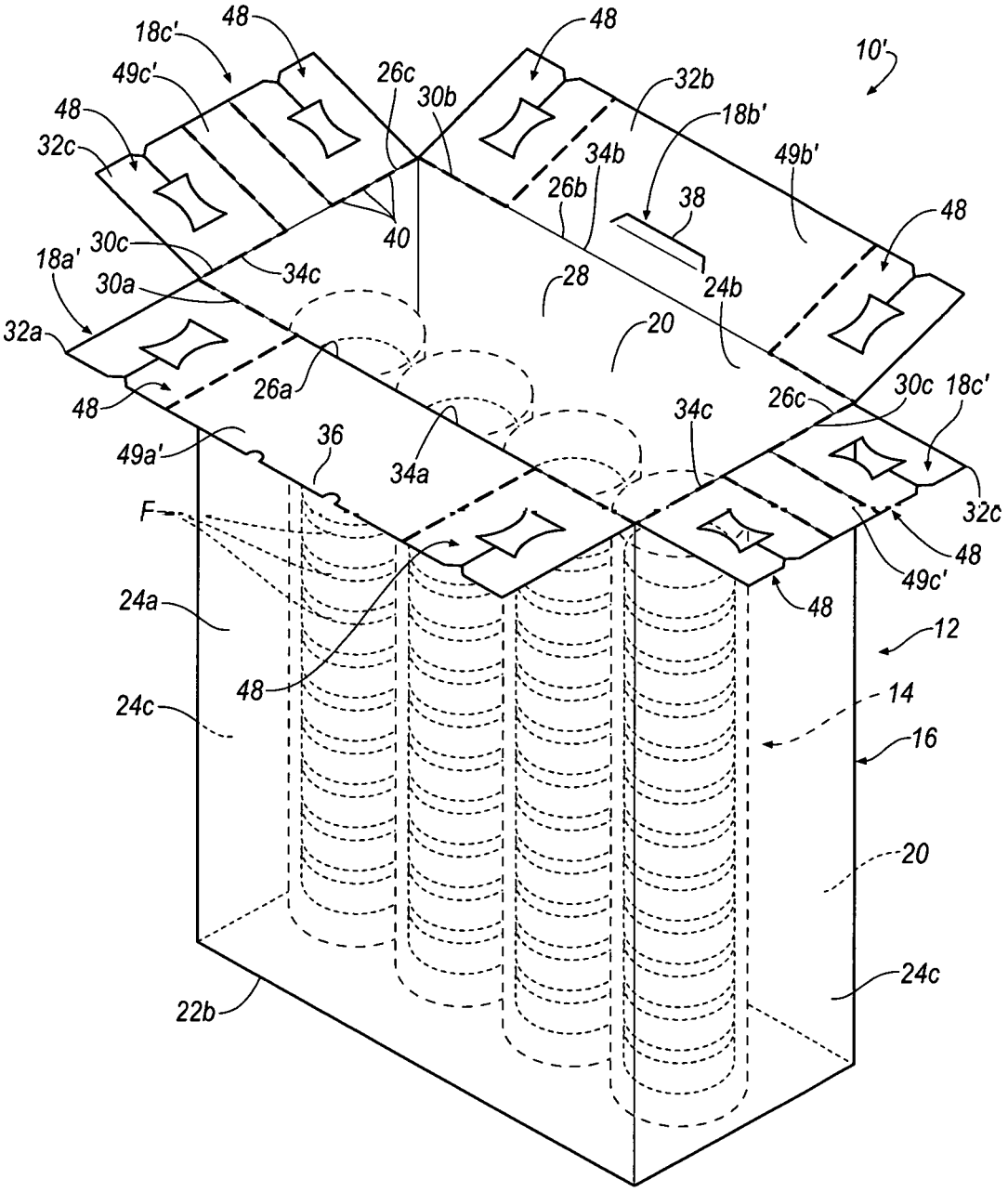
FIG. 8 is a perspective view illustrating a storage assembly comprising a container and a plurality of sleeves.

With reference to FIG. 6, one of the end flaps 18*c* comprising a pair of the clips 48 is shown in detail. The clips 48 may be joined together along a common seam 50 extending between the proximal end 30*c* of the end flap 18*c* and the distal end 32*c* of the end flap 18*c*. In some examples, the common seam 50 comprises perforations 52 to provide a predefined tear path for separating the clips 48 from each other. With reference to the implementation of the storage assembly 10' shown in FIG. 8, any one of the flaps 18*a*', 18*b*', 18*c*' may comprise an intermediate member 49*a*', 49*b*', 49*c*' formed between the clips 48, whereby the clips 48 are spaced apart from each other by the intermediate member 49*a*', 49*b*', 49*c*'. For example, the front-side flap 18*a*' and/or the back-side flap 18*b*' may comprise one or more of the clips 48 formed at each end, whereby an intermediate member 49*a*', 49*b*' is continuously formed and does not comprises the clips 48. In use, the clips 48 may be removed, while the intermediate member 49*a*', 49*b*', 49*c*' remains attached to the main body 16.

Figure 9:
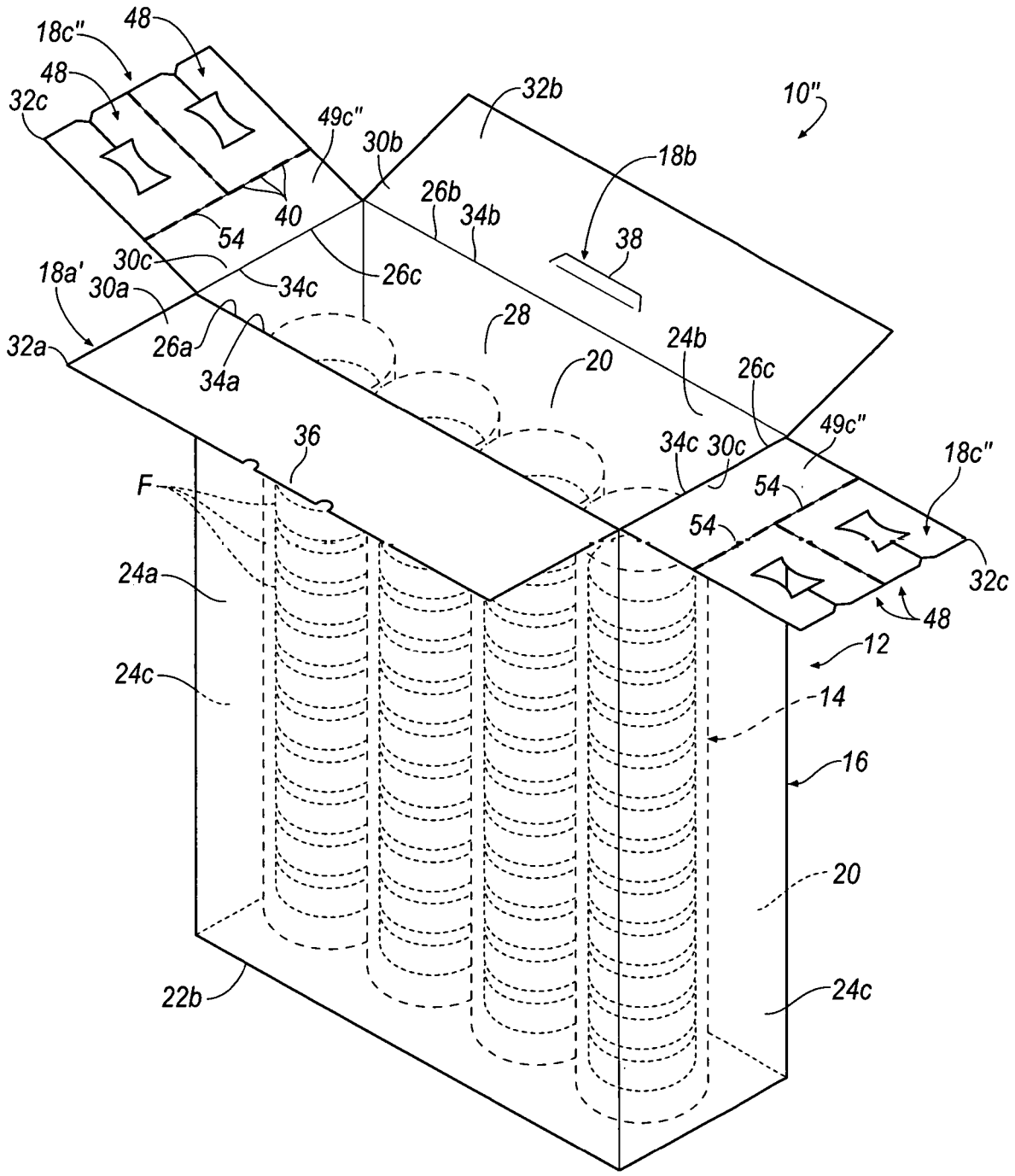
FIG. 9 is a perspective view illustrating a storage assembly comprising a container and a plurality of sleeves.

As shown in FIG. 6, each clip 48 comprises a proximal edge 54 and a distal edge 56. In some examples, the proximal edge 54 and the distal edge 56 are commonly formed with the proximal end 30*c* and the distal end 32*c* of the end flap 18*c*, 18*c*', as shown in FIGS. 1-8. In some examples, the proximal edge 54 of the clip may be spaced apart from the proximal end 30*c* of the end flap 18*c*". For example, as shown in FIG. 9, the end flap 18*c*" may comprise an intermediate member 49*c*" disposed between the proximal end 30*c* of the end flap 18*c*" and the proximal edge 56 of the clip 48, whereby when the clip 48 is removed from the end flap 18*c*", the intermediate member 49*c*" remains.

With continued reference to FIG. 6, an opposing pair of sides 58 extend between the proximal edge 54 and the distal edge 56. Accordingly, the proximal edge 54, the distal edge 56, and the sides 58 collectively define an outer perimeter 60 of the clip 48. As shown, one of the sides 58 of one the clips 48 may be joined to one of the sides 58 of another one of the clips 48 along the common seam 50 to form the end flap 18*c*. Accordingly, the clips 48 are separable from each other by tearing the end flap 18*c* along the common seam 50 to separate the joined sides 58 of the clips 48. As provided above, the flaps 18*a*, 18*b*, 18*c*, may include the intermediate member 49*a*, 49*b*, 49*c*, whereby the clips 48 are spaced apart from each other.

Each clip 48 further comprises an opposing pair of tabs 62 defining an aperture 64 and a passage 66. A shown, the aperture 64 is formed in an intermediate portion of the clip 48, and the passage 66 extends between the aperture 64 and the outer perimeter 60 to provide a path for insertion of the sleeve 14 into the aperture 64. The tabs 62 of the clip 48 may be bent in opposite directions to expand the passage 66

In some examples, the aperture 64 is formed through the thickness T of an intermediate region of the clip 48. The aperture 64 may comprise a narrowed portion 68 configured to crimp the sleeve 14 within the aperture 64. For example, a width $W_A$ of the aperture 64 may be variable or tapered along direction from the proximal edge 54 to the distal edge 56 of the clip 48, wherein the width $W_{A1}$ at an intermediate region of the aperture 64 is less than the width $W_{A2}$ at an end of the aperture 64. In the illustrated example, the aperture 64 is hourglass shaped, and comprises a first opposing pair of convergent sidewalls 70 and a second opposing pair of straight sidewalls 72 extending between the convergent sidewalls 70. Although the convergent sidewalls 70 are shown as being convex, they may also be polygonal, irregular, or a combination thereof.

The passage 66 extends between the aperture 64 and the outer perimeter 60 of the clip 48 so that the sleeve 14 can be received in the aperture 64 via the passage 66. In the illustrated example, the passage 66 extends between one of the straight sidewalls 72 of the aperture 64 and the distal edge 56 of the clip 48. In other examples, the passage 66 may extend between any one of the sidewalls 70, 72 of the aperture 64 and a corresponding one of the sides 58 or the proximal edge 54 of the clip 48.

A width $W_P$ of the passage 66 is substantially constant and a may be selected to accommodate a passage of the sleeve 14 therethrough. Alternatively, the width $W_P$ of the passage 66 may be variable. The passage 66 may comprise an inlet 74 formed adjacent the outer perimeter 60 of the clip 48, configured to guide the sleeve 14 into the passage 66. For example, the inlet 74 may be a flared portion of the passage 66, whereby a width of the passage 66 increases along a direction from the aperture 64 to the distal edge 56.

The sleeves 14 are configured to store one or more of the foodstuffs F therein. In some examples, the sleeves 14 are formed of one or more pliable sheets arranged to define an interior void 76 for receiving a plurality of foodstuffs F therein. The interior void 76 may initially be hermetically sealed to minimize exposure of the foodstuffs F to an ambient environment. In the example shown in FIGS. 1-7, each of the sleeves 14 is a slug configured to receive a stack of foodstuffs F, such as crackers, biscuits, wafers, potato chips, or the like. More particularly, the illustrated sleeves 14 are a cylindrical slugs configured to receive a stack of cylindrical or disc-shaped foodstuffs F therein. In other examples, the sleeves 14 may be multi-sided slugs for receiving foodstuffs F having a corresponding shape, such as polygonal or irregular-shaped foodstuffs. Alternatively, the sleeves 14 may be two-sided bags or packets, or may be rigid enclosures having a pliable closure portion.

Figure 7:
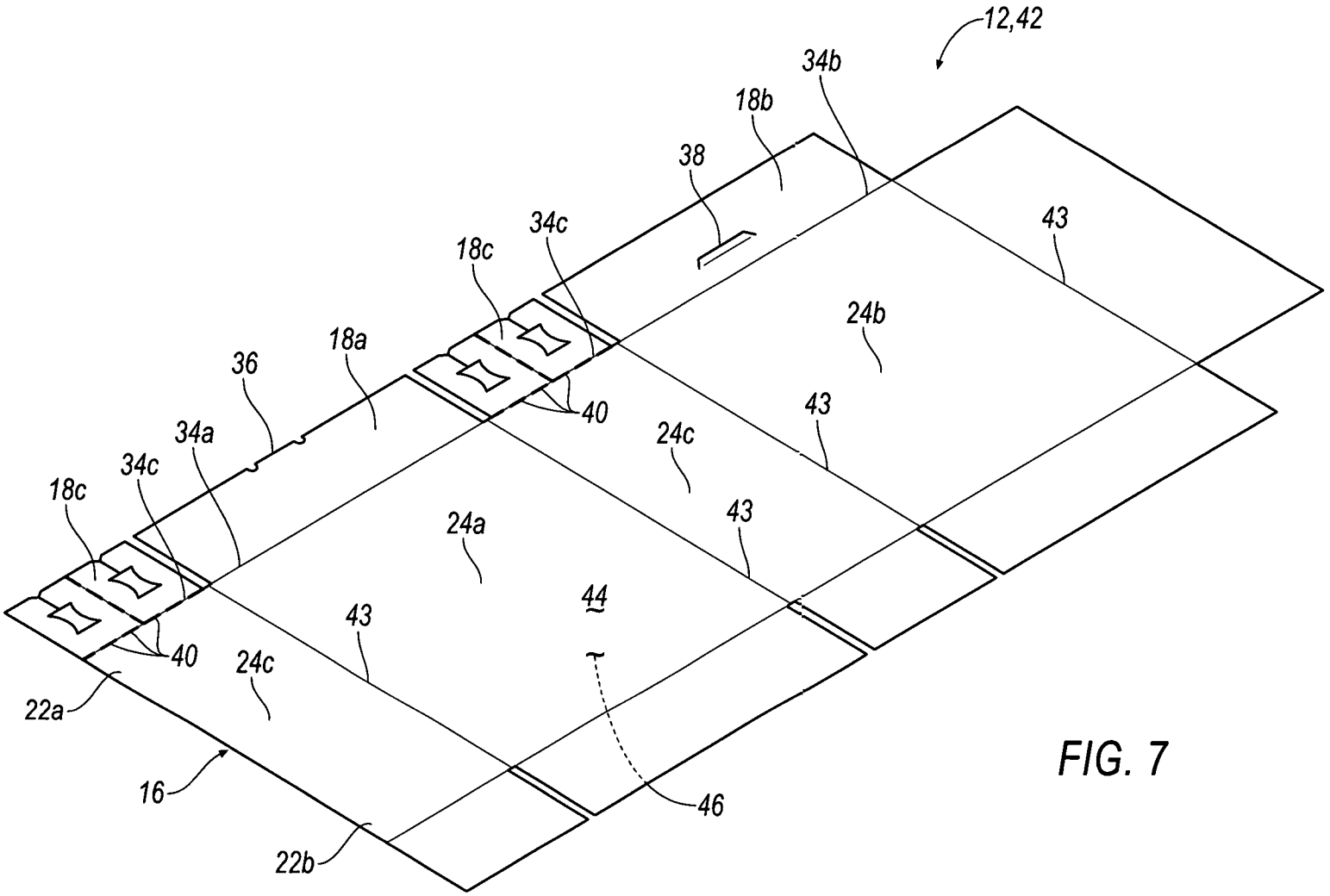
FIG. 7 is a perspective view of an unfolded material blank for forming the container of FIG. 1.

In some examples, the container 12 may be a carton, whereby the flaps 18*a*, 18*b*, 18*c* and the sidewalls 24*a*, 24*b*, 24*c* of the main body 16 are integrally formed from a single piece of material, such as a wax-coated cardboard and folded to form the container 12. As shown in FIG. 7, a substantially planar blank 42 comprising the sidewalls 24*a*, 24*b*, 24*c* and flaps 18*a*, 18*b*, 18*c* is cut from the single piece of the material and configured to be folded along respective sidewall seams 43 to form the container 12. As shown, the blank 42 comprises an inner surface 44 and an opposing outer surface 46 defining respective inner surfaces 44 and outer surfaces 46 of each of the sidewalls 24*a*, 24*b*, 24*c* and the flaps 18*a*, 18*b*, 18*c*. A distance between the inner surface 44 and the outer surface 46 defines a thickness T of each of the flaps 18*a*, 18*b*, 18*c* and the sidewalls 24*a*, 24*b*, 24*c* (see e.g., FIG. 6). In other examples, any one of the flaps 18*a*, 18*b*, 18*c* or the sidewalls 24*a*, 24*b*, 24*c* may be separately formed and joined together with the other flaps 18*a*, 18*b*, 18*c* and sidewalls 24*a*, 24*b*, 24*c* using fasteners, such as adhesive, tape, or mechanical fasteners, and may have a different thickness from other flaps 18*a*, 18*b*, 18*c* and sidewalls 24*a*, 24*b*, 24*c*.

With renewed reference to FIGS. 1-5, an example of one implementation of the instant disclosure is provided. As shown in FIG. 1, the container 12 is initially provided in a sealed configuration, wherein each of the sleeves 14 is sealingly enclosed within the interior cavity 20 of the container 12. In the sealed configuration, the flaps 18*a*, 18*b*, 18*c* of the container 12 are in the closed position, whereby the end flaps 18*c* of the container 12 are disposed beneath the front-side flap 18*a* and the back-side flap 18*b*. At least two of the flaps 18*a*, 18*b*, 18*c* may be joined to each other to secure the flaps 18*a*, 18*b*, 18*c* in the closed position. For example, the inner surface 44 of the front-side flap 18*a* may be adhesively bonded to the outer surface 46 of the back-side flap 18*b*.

At FIG. 2 of the disclosure, the container 12 is initially opened by a consumer 100 to expose the interior cavity 20, comprising the sleeves 14. As shown, each of the end flaps 18*c* is initially formed as a unitary body, whereby the clips 48 forming each of the end flaps 18*c* are joined to each other along the common seam 50.

Figure 3:
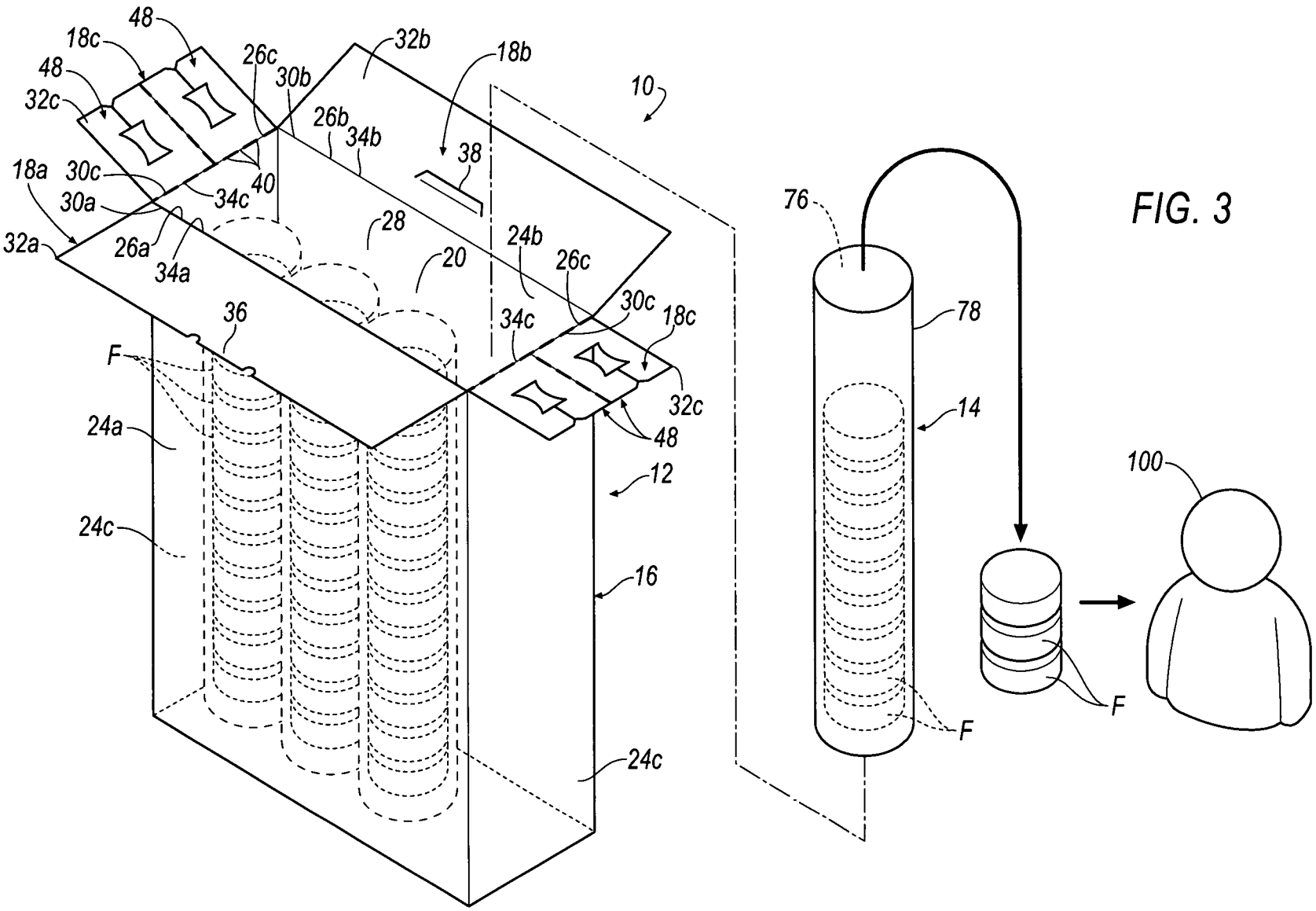
FIG. 3 is a perspective view of the storage assembly of FIG. 1, where one of the sleeves is removed from the container.

At FIG. 3, one of the sleeves 14 is withdrawn from the interior cavity 20, and a first end 78 of sleeve 14 is opened to expose the interior void 76 of the sleeve 14, including the foodstuffs F contained therein. The consumer 100 may remove a first portion of the foodstuffs F, while leaving a second portion of the foodstuffs F within the interior void 76 of the sleeve 14.

Figure 4A:
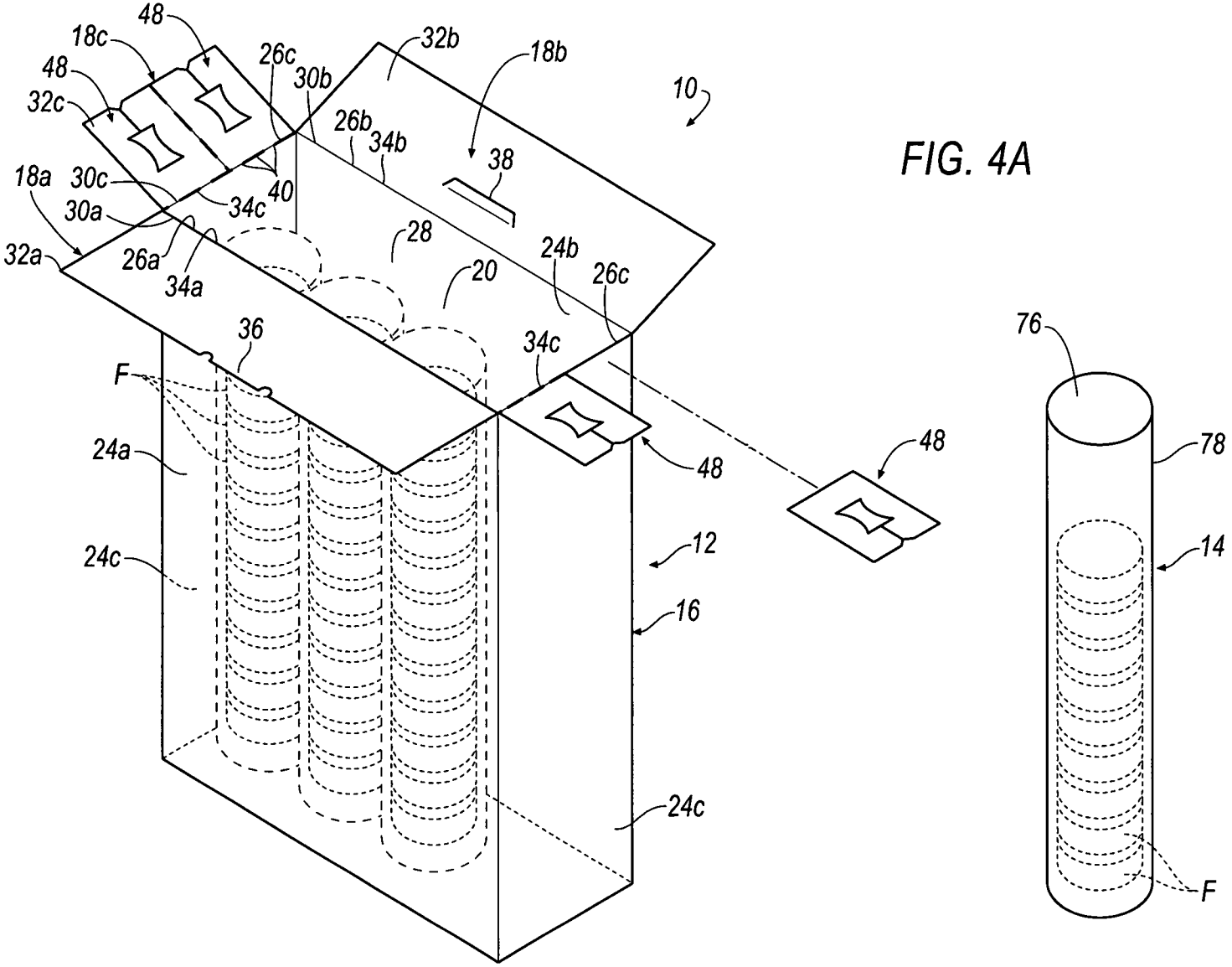
FIG. 4A-4C are partially exploded perspective views of the storage assembly of FIG. 1, showing the steps of resealing the sleeve.
Figure 4C:
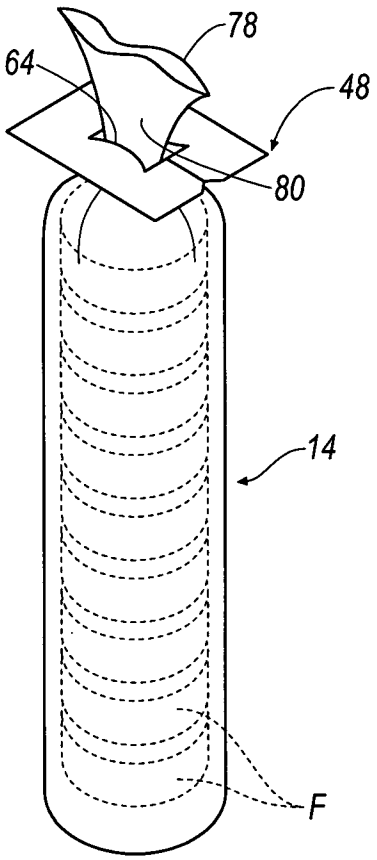
Figure 4B:
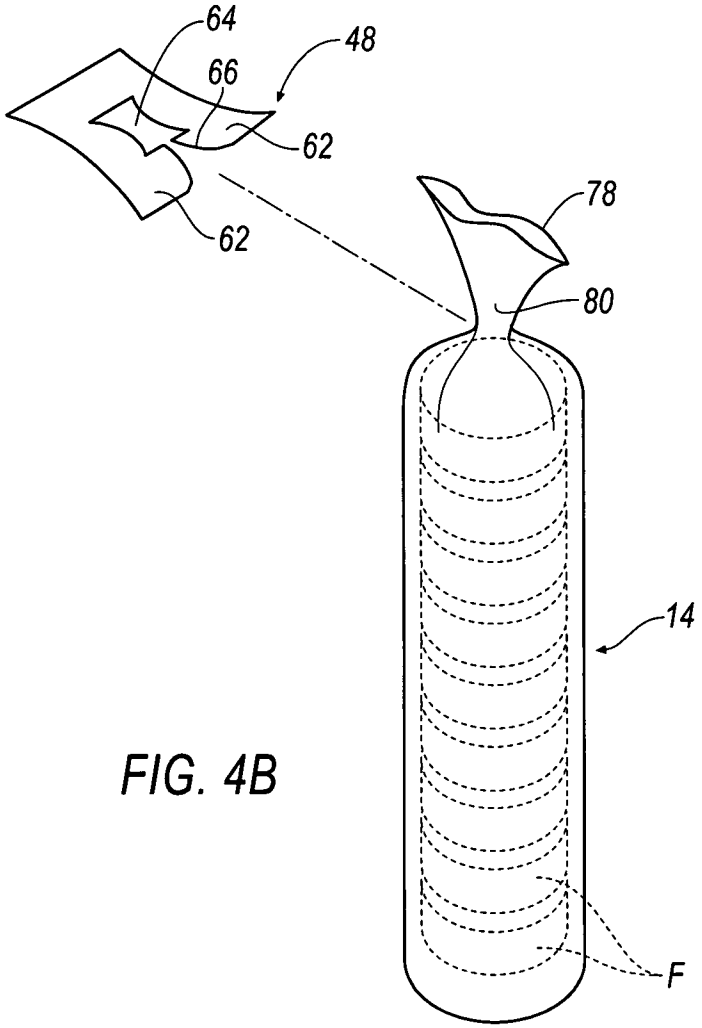

Once the desired first portion of the foodstuffs F is removed from the interior void 76 of the sleeve 14, one of the clips 48 may be separated from the container 12 by tearing the clip 48 along the common seam 50 and a corresponding portion of the end flap seam 34*c*, as shown in FIG. 4A. As shown in FIG. 4B, the sleeve 14 may be resealed by rolling or twisting the opened first end 78 to form a necked portion 80 configured to be received within the aperture 64 of the clip 48. The necked portion 80 of the sleeve 14 is then introduced to the passage 66 via the tapered inlet 74. In some examples, where the clip 48 may be formed of a resilient material, such as a cardboard or plastic, the tabs 62 of the clip 48 can be spread apart from each other to temporarily increase the width $W_P$ of the passage 66. The necked portion 80 of the sleeve 14 is then passed through the passage 66 and received in the aperture 64 of the clip 48, as shown in FIG. 4C. The necked portion 80 of the sleeve 14 may be disposed within the narrowed portion 68 of the clip 48 to prevent the necked portion 80 from reopening.

Figure 5:
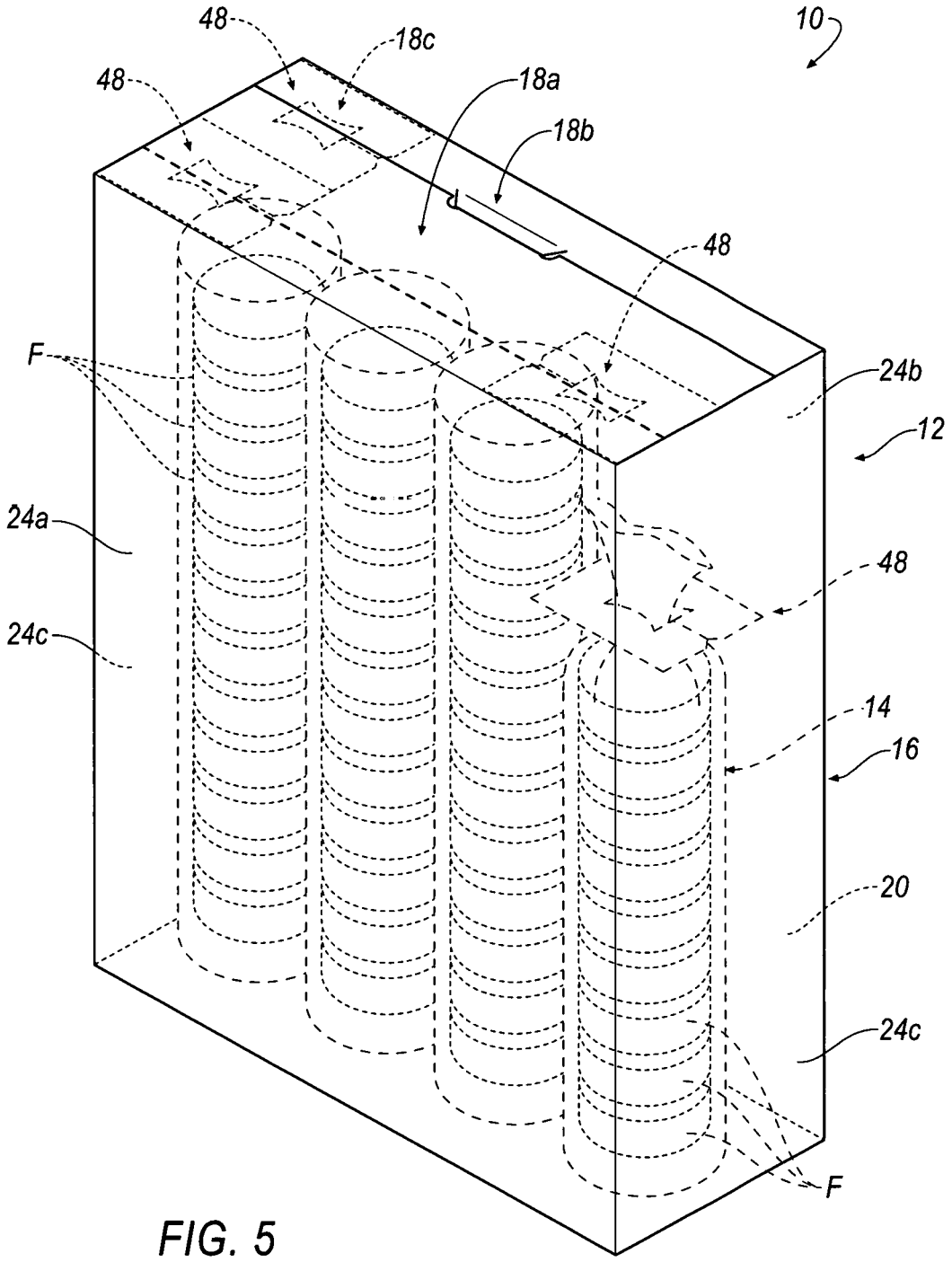
FIG. 5 is a perspective view of the storage assembly of FIG. 1, where resealed sleeve is replaced within the container.

At FIG. 5 the resealed sleeve 14, including the clip 48, is replaced within the interior cavity 20 of the container 12 and the flaps 18*a*, 18*b*, 18*c* are moved to the closed position to enclose the interior cavity 20. As discussed above, the front-side flap 18*a* may engage the back-side flap 18*b* to secure the flaps 18*a*, 18*b*, 18*c* in the closed position.

In the illustrated example, a single one of the sleeves 14 is removed and opened at a time. This may be the case where each of the sleeves 14 comprises identical foodstuffs, and the sleeves 14 are opened sequentially. In other examples, the sleeves 14 may contain different varieties of foodstuffs and the consumer 100 may open each of the sleeves 14 simultaneously. In this case, each of the clips 48 may be simultaneously removed from the container 12 so that the container 12 is left with only the front-side flap 18*a* and the back-side flap 18*b*.

The examples of the packaging assemblies described above advantageously provide an integrated means for resealing a secondary package contained within the storage assembly 10. Accordingly, preservation of unconsumed foodstuffs remaining within the secondary package after a serving session is maximized.

A number of implementations have been described. Nevertheless, it will be understood that various modifications may be made without departing from the spirit and scope of the disclosure. Accordingly, other implementations are within the scope of the following claims. For example, the actions recited in the claims can be performed in a different order and still achieve desirable results.

What is claimed is:

1. A storage assembly, comprising:

a container defining an interior cavity, the container comprising a first sidewall and a second sidewall;

a first flap fixedly attached to the first sidewall; and a second flap removably attached to the second sidewall of the container, the second flap having at least one aperture formed therethrough and a passage extending from the aperture to an outer perimeter of the second flap.

2. The storage assembly of claim 1, wherein the second flap comprises a first clip and a second clip.

3. The storage assembly of claim 1, wherein the second flap is attached to the second sidewall of the container along a perforated seam.

4. The storage assembly of claim 1, wherein the passage comprises a tapered inlet disposed adjacent the outer perimeter.

5. The storage assembly of claim 1, wherein the aperture comprises a first pair of converging sidewalls and a second pair of straight sidewalls connecting the converging sidewalls.

6. The storage assembly of claim 1, wherein the aperture is hourglass shaped.

7. The storage assembly of claim 1, wherein the first flap and the second flap are operable between an open position to at least partially expose the interior cavity of the container and a closed position to at least partially enclose the interior cavity of the container.

8. The storage assembly of claim 7, wherein in the closed position, second flap is concealed by the first flap.

* * * * *